US005390642A

United States Patent [19]

Thoma

[11] Patent Number: 5,390,642

[45] Date of Patent: Feb. 21, 1995

[54] FUEL INJECTION SYSTEM ARRANGEMENT FOR AN INTERNAL COMBUSTION ENGINE

[75] Inventor: Frank Thoma, Stuttgart, Germany

[73] Assignee: Mercedes-Benz AG, Stuttgart, Germany

[21] Appl. No.: 222,723

[22] Filed: Apr. 1, 1994

Related U.S. Application Data

[63] Continuation of Ser. No. 40,889, Mar. 31, 1993, abandoned.

[30] Foreign Application Priority Data

Apr. 11, 1992 [DE] Germany ..... 4212255

[51] Int. Cl.[6] ..... F02M 37/04

[52] U.S. Cl. ..... 123/508; 123/509

[58] Field of Search ..... 123/508, 509, 495, 458, 123/506

[56] References Cited

U.S. PATENT DOCUMENTS

| | | | |
|---|---|---|---|
| 1,119,657 | 12/1914 | Steinbecker | 123/509 |
| 2,955,582 | 10/1960 | Taylor | 123/508 |
| 4,538,561 | 9/1985 | Amemori | 123/508 |
| 4,760,831 | 8/1988 | Altdorf | 123/509 |
| 4,811,715 | 3/1989 | Djordjevic | 123/506 |
| 4,917,069 | 4/1990 | Kuhlen | 123/509 |
| 4,969,600 | 11/1990 | Nicol | 123/458 |
| 5,161,496 | 11/1992 | Matsushima | 123/508 |

FOREIGN PATENT DOCUMENTS

| | | | |
|---|---|---|---|
| 0066718 | 12/1982 | European Pat. Off. . | |
| 0210098 | 1/1987 | European Pat. Off. . | |
| 3105412 | 9/1982 | Germany . | |
| 3633136 | 4/1988 | Germany . | |
| 340892 | 5/1936 | Italy | 123/508 |
| 0333545 | 8/1930 | United Kingdom . | |
| 0693148 | 6/1953 | United Kingdom . | |
| 982334 | 3/1965 | United Kingdom . | |
| 2195708 | 4/1988 | United Kingdom . | |
| 8101593 | 6/1981 | WIPO | 123/508 |

*Primary Examiner*—Carl S. Miller
*Attorney, Agent, or Firm*—Klaus J. Bach

[57] ABSTRACT

In a fuel injection system arrangement comprising as components for each cylinder of an internal combustion engine a pump, a solenoid valve and an injector mounted on the housing of the internal combustion engine, at least one component of the fuel injection system, preferably the pump component together with the solenoid valve, is mounted on the cylinder head cover with the pump being operated by a cam shaft mounted under the cylinder head cover. The arrangement provides for simple retrofitting and replacement of parts.

6 Claims, 1 Drawing Sheet

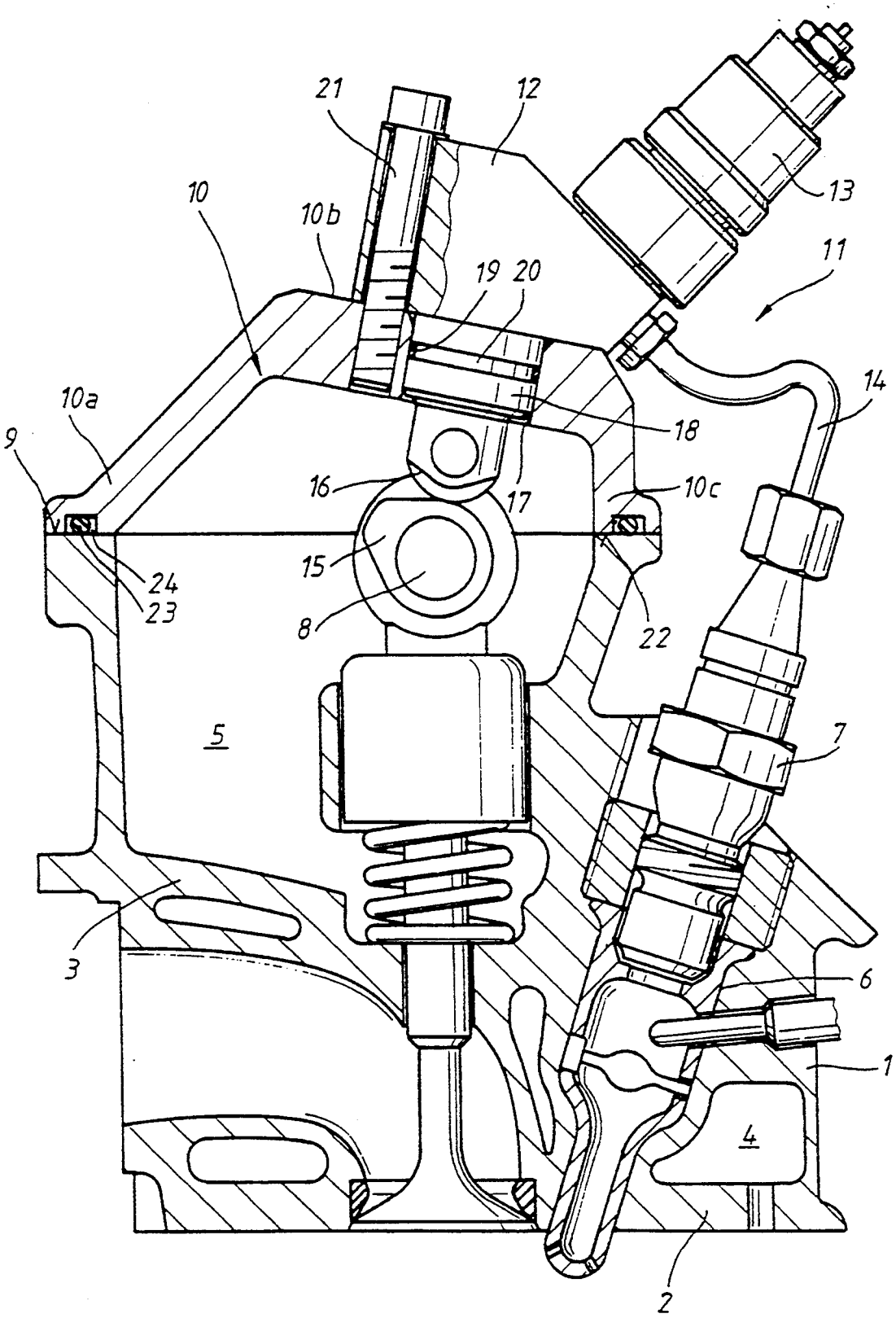
21
12
13
10
10b
11
19
20
14
10a
18
9
16
17
10c
15
24
23
8
22
5
7
3
6
1
4
2

FUEL INJECTION SYSTEM ARRANGEMENT FOR AN INTERNAL COMBUSTION ENGINE

This application is a continuation of application Ser. No. 08/040,889, filed Mar. 31, 1993, now abandoned.

BACKGROUND OF THE INVENTION

The invention relates to a fuel injection system arrangement for an internal combustion engine comprising as components a pump element and an injector mounted on the internal combustion engine.

An arrangement of such a generic type is known from German DOS 3,633,136. It comprises, for each cylinder, a fuel injection device consisting of a pump, a solenoid valve and an injection nozzle. In this arrangement, however, the pump, together with the solenoid valve for controlling the injection quantity, is mounted on the cylinder head, and the injector is mounted separately from the pump and the injector also is connected to the pump via a short pressure line.

It is the object of the present invention to provide an arrangement for such a fuel injection arrangement which however is largely independent of the cylinder head design and, if required, can be used, essentially without structural changes, in existing cylinder head designs.

SUMMARY OF THE INVENTION

In a fuel injection system arrangement comprising as components for each cylinder of an internal combustion engine a pump, a solenoid valve and an injector mounted on the engine, at least one of the components, preferably the pump together with the solenoid valve, is mounted on the cylinder head cover. The pump includes a plunger which is disposed adjacent a cam shaft supported on the cylinder head under the cover so as to be directly operated by a cam on the cam shaft. The engine cylinders are preferably provided with individual pump and solenoid components which are easily replaceably mounted in support bores formed in the cylinder head cover. Also preferably the solenoid valve is disposed at an angle with respect to the axis of the associated pump so as to provide for relatively low height of the arrangement.

Since at least a major component of the fuel injection system is mounted on the cylinder head cover, space on the cylinder head is not used, so that there is no need for any restrictions concerning the design shape and location of structural components of the internal combustion engine which need to be accommodated in the cylinder head structure for appropriate functioning of an engine.

Depending on which components of the fuel injection system are arranged on the cylinder head cover, virtually no structural change to the cylinder head is necessary. This is achieved in a simple manner if the pump, together with the solenoid valve, is mounted on the cylinder head cover. Such an arrangement also has the advantage that the fuel injection system according to the invention can also be retrofitted to cylinder head housings already in production.

BRIEF DESCRIPTION OF THE DRAWINGS

The sole FIGURE is a cross-sectional view of a cylinder head with a diesel engine fuel injection pump arrangement mounted on the cylinder head cover.

DESCRIPTION OF A PREFERRED EMBODIMENT

The FIGURE shows a cylinder head housing 1 of a preferably multi-cylinder diesel engine, which has a base plate 2 forming the top wall of the main combustion chamber of the diesel engine (not shown). Located at a distance above the base plate 2 is a cylinder head top structure 3 which separates a cooling water space 4 from a control space 5 arranged thereabove. Gas flow channels and a mounting cavity 6 for an injector 7 extend through the cooling water space 4. Bearing structures for mounting a cam shaft 8 are provided in the control space 5. The walls defining the control space 5 are flush at the top so as to provide a mounting surface 9 for a cylinder head cover 10.

The diesel engine includes a fuel injection system 11 which consists, For each cylinder, of the injector 7 and of a pump component 12 including a solenoid valve 13. The pump component 12 is connected to the injector 7 by means of a short pressure line 14. Connected to the pump component 12 is a fuel supply line (not shown) which extends to a fuel tank.

The pump component 12 is actuated by the cam shaft 8 which, in addition to the control cams for the cylinder valves, has, for each pump component 12, a pump cam 15 which acts on a roller tappet 16 on the pump component 12. The fuel injection quantity provided by the pump component 12 is controlled by timed activation of the solenoid valve 13 in dependence on operating parameters of the diesel engine obtained from an electronic control device.

According to the invention, the fuel injection system 11 consisting of the injector 7, pump component 12 and solenoid valve 13 is mounted on the housing of the diesel engine in such a way that at least one component of the fuel injection system is supported on the cylinder head cover 10. According to a preferred embodiment as shown in the FIGURE, the pump component 12 is unitary with the solenoid valve 13 and as an integral component is mounted on the cylinder head cover 10, whereas the injector 7 is mounted on the cylinder head 1. Such an arrangement of the fuel injection device 11 requires no more than insignificant structural changes to a normal cylinder head housing 1 if any. Within the scope of the invention, any combinations are possible in respect the arrangement of the components of the fuel injection device 11 on the cylinder head cover 10.

For mounting the pump component 12, which is designed as a plug-in pump, the cylinder head cover 10 is provided with a mounting bore 17, into which the cylindrical shank portion 18 of the pump component 12 is inserted. The pump component 12 is sealed in the mounting bore 17 by means or a seating ring 19 received in a groove 20 or the shank portion 18. The housing part of the pump component 12, which projects outwardly from the cylinder head cover 10. covers the mounting bore 17 in a flange-like manner and is fastened to a flat surface portion of the cylinder head cover 10 by means or screws 21. The pump component 12 is properly oriented on the cylinder head cover 10 either via the connection of the projecting housing part or via the shank portion 18 within the mounting bore 17. To save structural height, the solenoid valve 13 is arranged at an oblique angle relative to the direction of movement or the pump tappet 16.

The cylinder head cover 10 is trough-like with two inclined side wall portions **10*a* and 10*c* and a top wall portion 10***b* extending between the side wall portions, the pump component 12 being fastened to the top wall portion 10*b*. To achieve an extremely low structural height, the pump component 12 and/or the solenoid valve 13 may, of course, be arranged on one or the side wall portions 10*a* or 10*c*.

In order for the cylinder head cover 10 to be capable or absorbing the stresses resulting from the arrangement or the pump component, the cylinder head cover is provided with reinforcements. These reinforcements can be formed by ribs extending between the portions 10*a* to 10*c* or by predetermined wall thicknesses individual portions 10*a* to 10*c*. According to the exemplary embodiment, the cylinder head cover 10 is made stronger by means of a greater wall thickness of the top wall portion 10*b* in relation to the side wall portions 10*a* and 10*c*. Correspondingly, if the pump component 12 is arranged on one of the side wall portions 10*a* or 10*c*, these can be strengthened by means of ribs or an increased wall thickness. Overall, a rigid construction of the cylinder head cover 10 is obtained thereby.

In order to provide furthermore for a rigid connection between the cylinder head cover 10 and the cylinder head structure 1, the two mounting surfaces 9 and 22 are in direct contact with one another, and the cylinder head cover 10 is interlocked with the cylinder head by means of screws. A cover gasket 23 provided here for sealing off the separating joint is arranged in a sealing groove 24 of the cover.

The arrangement according to the invention is not restricted to a diesel engine having a pre-combustion chamber, but it can be employed in the same way also in a diesel engine with direct injection of the fuel into the cylinders and also in diesel engines with a plurality of cam shafts.

What is claimed is:

1. A diesel engine fuel injection system arrangement comprising as components of each cylinder a pump and an injector mounted on said Diesel engine which has a cylinder head with cylinder valves and with a camshaft mounted thereon and including for each cylinder control cam for operating the cylinder valves and a cam for operating said pump for the injection of fuel into a combustion chamber under high pressure, and with a cylinder head cover fastened to the cylinder head so as to be independently removable therefrom for access to said control cams and said cylinder valves, said cylinder head cover having a top wall portion and side wall portions angled from said top wall portion, and said injection system pump being mounted on a wall portion of the cylinder head cover, with at least one of said wall portions being reinforced for rigidly supporting said pump, said pump having roller tappets seated on the respective cams to facilitate operation of said high pressure pump by said cam, said pump further having for each cylinder a solenoid valve integrally associated with said pump for timing fuel injection into the respective combustion chambers via said injector.

2. An arrangement according to claim 1, wherein said pump component is fitted into a mounting bore formed in the cylinder head cover and is releasably retained therein by means of screws.

3. An arrangement according to claim 2, wherein said cylinder head cover is screwed directly onto the cylinder head so as to be in immediate contact therewith.

4. An arrangement according to claim 3, wherein said pump component is arranged on the cylinder head cover so as to extend therefrom at an oblique angle.

5. An arrangement according to claim 4, wherein said cylinder head cover is of an inverted trough-like shape and has top and side wall portions with the pump component being mounted on the top wall portion.

6. An arrangement according to claim 1, wherein said solenoid valve is arranged with its axis disposed at an oblique angle with regard to the axis of said pump component.

* * * * *